US008857121B2

(12) United States Patent
Baxter et al.

(10) Patent No.: US 8,857,121 B2
(45) Date of Patent: Oct. 14, 2014

(54) LINEAR SURFACE COVERING SYSTEM

(75) Inventors: Nathan J. Baxter, Lancaster, PA (US); Eric Krantz-Lilienthal, Janesville, WI (US)

(73) Assignee: AWI Licensing Company, Wilmington, DE (US)

( * ) Notice: Subject to any disclaimer, the term of this patent is extended or adjusted under 35 U.S.C. 154(b) by 29 days.

(21) Appl. No.: 12/660,583

(22) Filed: Mar. 1, 2010

(65) Prior Publication Data

US 2010/0257808 A1 Oct. 14, 2010

Related U.S. Application Data

(60) Provisional application No. 61/156,036, filed on Feb. 27, 2009.

(51) Int. Cl.

| | |
|---|---|
| ***E04B 9/00*** | (2006.01) |
| ***E04B 9/26*** | (2006.01) |
| ***E04B 9/36*** | (2006.01) |
| ***E04B 9/04*** | (2006.01) |

(52) U.S. Cl.

CPC . *E04B 9/363* (2013.01); *E04B 9/26* (2013.01); *E04B 9/0464* (2013.01)

USPC ..... 52/506.08

(58) Field of Classification Search

CPC ..... E04F 13/07; E04F 13/076; E04F 13/08; E04F 13/0803; E04F 13/0805; E04F 13/081; E04F 13/0812; E04F 13/0814; E04F 13/0816; E04F 13/0819; E04F 13/083; E04F 13/0835; E04F 13/0851; E04F 13/0858; E04F 13/086; E04B 9/18; E04B 9/183; E04B 9/205; E04B 9/22; E04B 9/225; E04B 9/24; E04B 9/245; E04B 9/26; E04B 9/28; E04B 9/34

USPC ..... 52/480, 489.1, 489.2, 483.1, 506.01, 52/506.05, 506.06, 506.08, 506.09, 510, 52/384, 385, 386, 714, 715, 716.1, 716.6, 52/716.7, 716.8, 718.04, 290, 586.1, 586.2

See application file for complete search history.

(56) References Cited

U.S. PATENT DOCUMENTS

| | | | | |
|---|---|---|---|---|
| 325,009 | A * | 8/1885 | Peterson | 52/391 |
| 1,728,231 | A * | 9/1929 | Denk | 52/509 |
| 2,005,030 | A | 6/1935 | Geisinger | |
| 2,653,686 | A | 9/1953 | Routt | |
| 3,175,656 | A * | 3/1965 | Schoenfeld | 52/506.06 |

(Continued)

FOREIGN PATENT DOCUMENTS

| | | |
|---|---|---|
| DE | 1684060 | 5/1971 |
| DE | 9015211 | 11/1991 |
| WO | 9419561 | 9/1994 |
| WO | 0253859 | 7/2001 |

*Primary Examiner* — Jessica Laux

(74) *Attorney, Agent, or Firm* — Amy M. Fernandez

(57) ABSTRACT

The invention relates to a surface covering system, and, more specifically, to an improved linear surface covering system. The improvement includes each plank of the system having multi-directionally cut grooves. The improvement further includes clip projections which conform substantially to a notch formed by the multi-directional grooves. The system also includes an improved splice plate for stabilizing two adjacent planks positioned in end-to-end relation.

9 Claims, 5 Drawing Sheets

(56) References Cited

U.S. PATENT DOCUMENTS

| | | | | |
|---|---|---|---|---|
| 3,745,734 | A | 7/1973 | Davey et al. | |
| 4,033,083 | A * | 7/1977 | Fritz et al. | 52/489.1 |
| 4,395,858 | A | 8/1983 | Gwyther | |
| 4,546,587 | A * | 10/1985 | Mosch | 52/506.08 |
| 4,635,424 | A | 1/1987 | Drapeau | |
| 5,822,941 | A | 10/1998 | Kinsella | |
| 6,446,405 | B1 * | 9/2002 | Pervan | 52/403.1 |
| 7,010,894 | B1 | 3/2006 | Cappelle | |
| 7,121,059 | B2 * | 10/2006 | Pervan | 52/592.2 |
| 7,356,971 | B2 * | 4/2008 | Pervan | 52/578 |
| 2004/0060256 | A1 | 4/2004 | Frascari | |
| 2009/0151134 | A1 * | 6/2009 | Neuhofer, Jr. | 24/292 |

* cited by examiner

LINEAR SURFACE COVERING SYSTEM

CROSS REFERENCE TO RELATED APPLICATION

This application claims the benefit under 35 U.S.C. §119 (e) of U.S. provisional application Ser. No. 61/156,036, filed Feb. 27, 2009.

BACKGROUND OF THE INVENTION

The invention relates to a surface covering system, and, more specifically, to an improved linear surface covering system.

Conventional linear surface covering systems are sold by Armstrong World Industries, Inc. under the name WOODWORKS® Linear ceilings and Rulon Company under the name Linear Wood. These systems generally include a plurality of linear planks which are designed to install on linear carriers having factory attached clips. These conventional systems assure alignment and consistent spacing of planks.

The planks of these systems include a pair of grooves, or kerfs routed through the back surface of the plank. These grooves extend into the interior of the plank in a direction generally perpendicular to the back surface. The aforementioned factory-attached clips each have projections that insert into these grooves. In order for a plank to be seated fully on a linear carrier, the plank must be pushed onto the clip thereby allowing the clip projections to enter the grooves. Unfortunately, the existing groove and clip projection interface requires tool adjustment. For example, use of a clamping tool or mallet is likely necessary to ensure that the clip projections achieve a deep seat within the plank grooves and, thus, remain fixedly attached. Additionally, for proper installation, it may be required to draw tight any planks not fitting tightly on the carrier using a screw-type fastener, such as a self-tapping screw. This tightening is typically done after the planks have been seated into place by the necessary tool adjustment.

Additionally, since the linear planks themselves are typically made of natural building materials, they react to changes in humidity and natural stresses and, thus, have a tendency to warp, twist laterally or bow. As a result, without proper support, the seams at the plank ends, i.e. at the butt joint location, may be uneven or slightly twisted. Conventional wisdom for preventing uneven surfaces at these butt joint locations include increasing the thickness of the planks and/or adding reinforcement at the butt joint. What is needed is an improved system which facilitates quicker and simplified assembly in the field and improves stability at the plank seams.

SUMMARY OF THE INVENTION

The invention is an improved surface covering system having a plurality of planks which are installed on linear carriers having factory-applied clips attached thereto. The planks have first and second grooves routed through the back surface thereof. The factory-attached clips have projections that insert into these grooves. The improvement includes each plank having multi-directionally cut grooves. Preferably, at least a portion of these multi-directionally cut grooves are sloped in the direction toward one another. The improvement further includes clip projections which conform substantially to a notch formed by the multi-directional grooves.

The system also includes an improved splice plate for stabilizing two adjacent planks positioned in end-to-end relation. The splice plate has projections which are inserted into the multi-directional grooves of two abutting planks such that the splice is positioned across the butt joint. The splice plate also serves to align the planks laterally. The improvement includes the splice plate projections conforming substantially to a notch formed by the multi-directional grooves. The splice plate also includes a pair of reinforcement wings to counteract stresses which would otherwise result in misalignment at the butt joint location.

The aforementioned improvements also eliminate the need for tool adjustment to ensure the projections of both the clip and splice plate achieve a deep enough seat in the grooves in the back side of the plank. Mere hand pressure is enough to tightly seat the projections of both the clip and splice plate into the plank grooves.

BRIEF DESCRIPTION OF THE DRAWINGS

The same reference numbers will be used throughout the drawings to refer to the same or like parts.

DETAILED DESCRIPTION OF THE DRAWINGS

Figure 1:
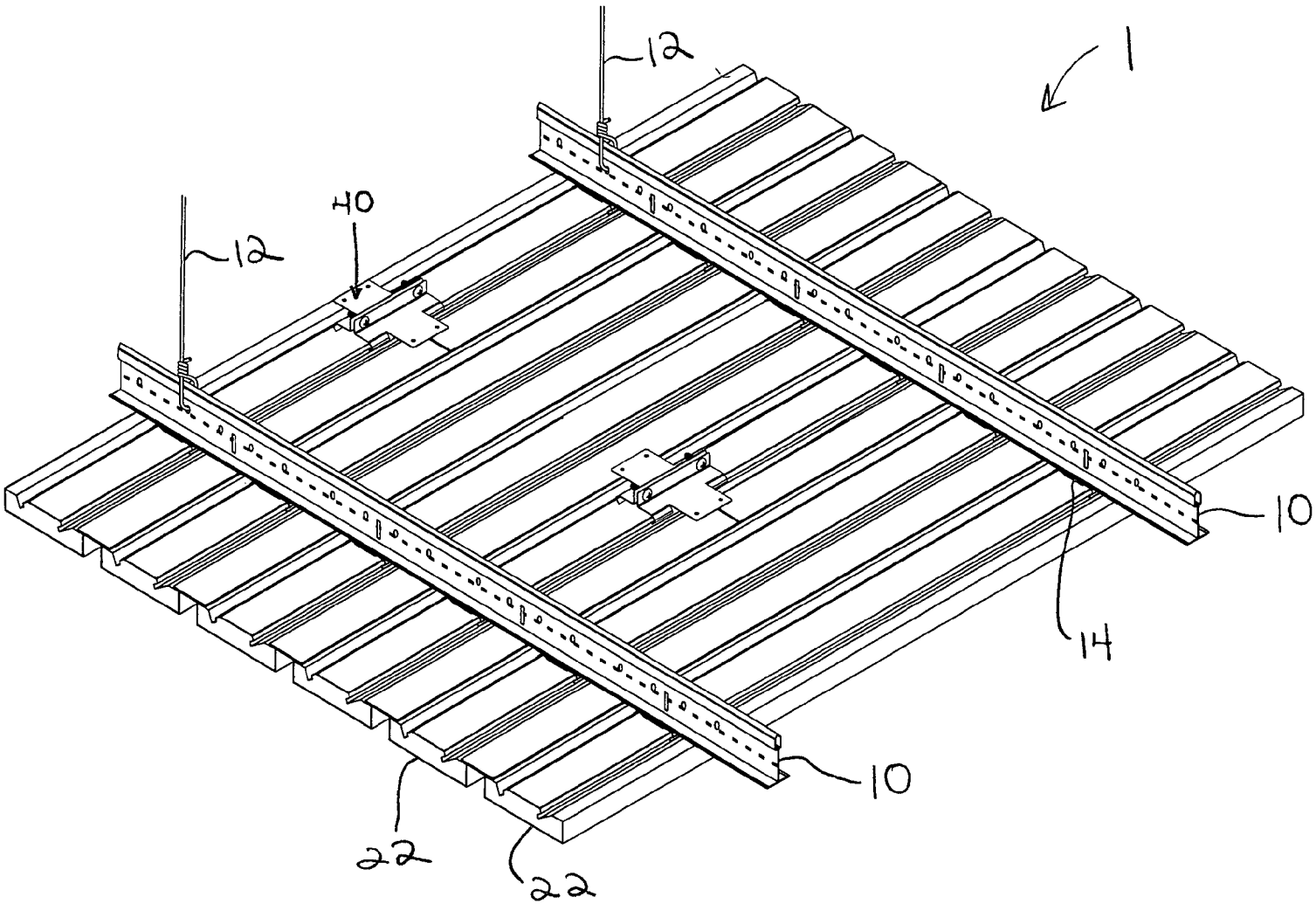
FIG. 1 is a topside perspective view a portion of an exemplary surface covering system of the invention.
Figure 2:
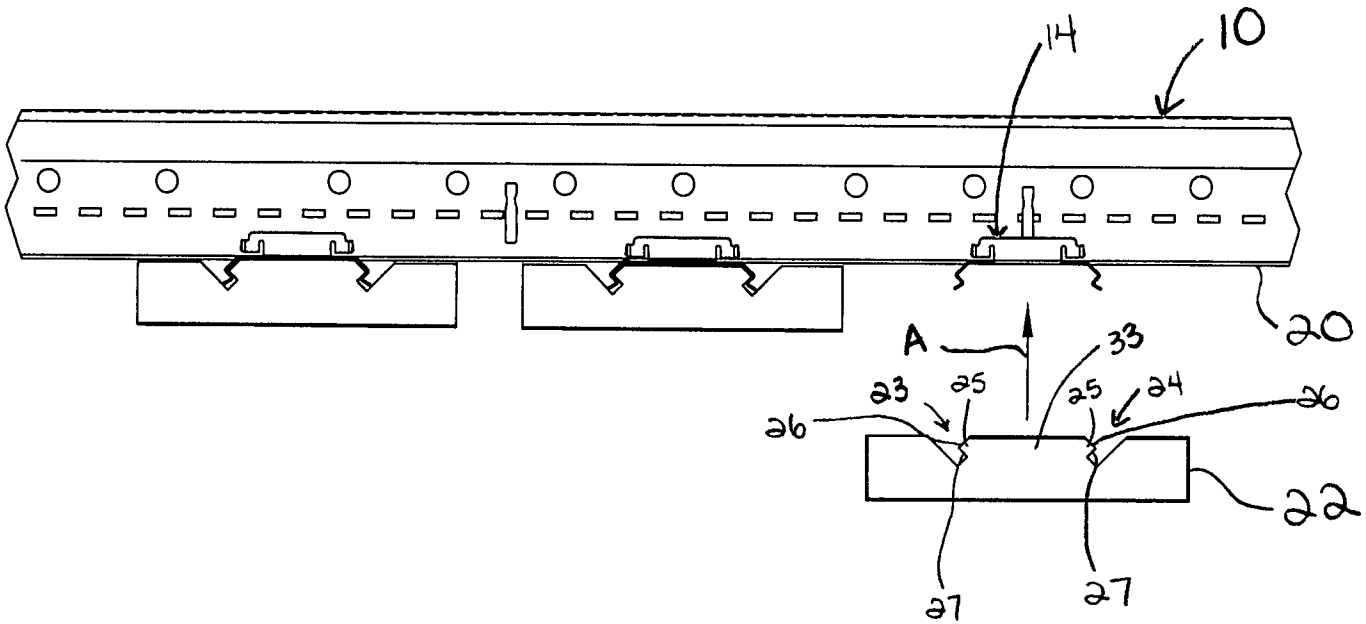
FIG. 2 is a side elevation view, partially exploded, of a portion of an exemplary surface covering system of the invention.
Figure 3:
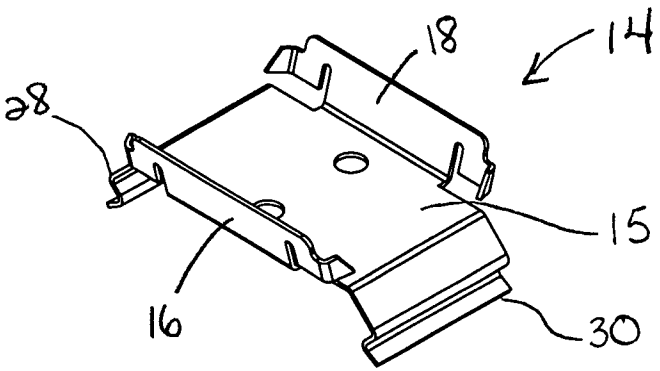
FIG. 3 is a perspective view of an exemplary clip.
Figure 6:
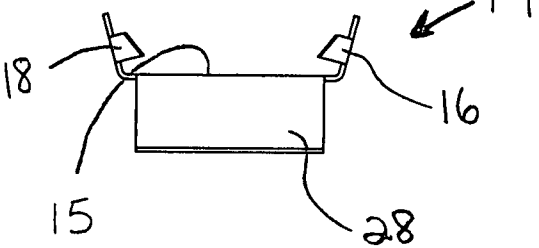
FIG. 6 is a side elevation view of an exemplary clip.
Figure 4:
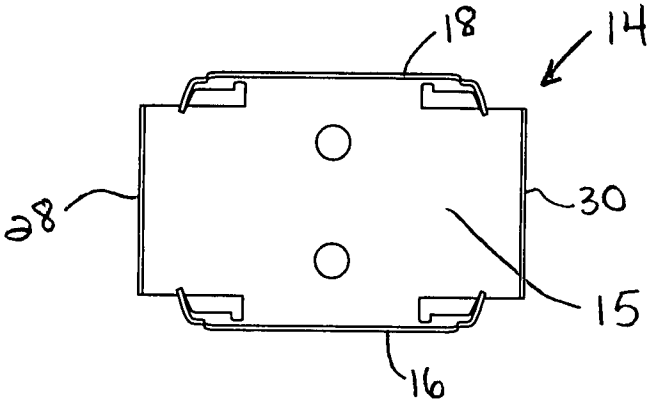
FIG. 4 is a top plan view of an exemplary clip.
Figure 5:
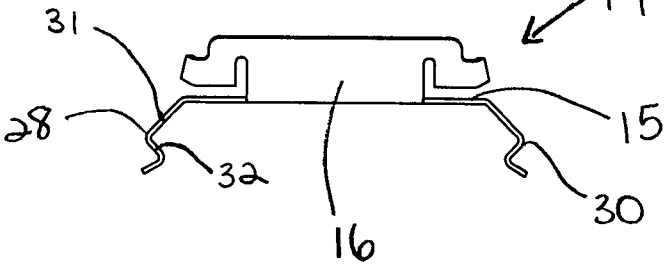
FIG. 5 is a front elevation view of an exemplary clip.

FIGS. 1 and 2 illustrate the improved surface covering system 1. As shown, a plurality of linear carriers 10 are suspended in parallel relation to one another from ceiling hangers 12 such as the hanger wires shown therein. The linear carrier 10 may be a conventional inverted T-shaped grid element as shown. A plurality of clips 14 are attached to the carriers. As best shown in FIGS. 3-6, the clips have a substantially flat main body portion 15 having first and second opposed resilient carrier attachment legs 16, 18 which can be snapped up over the base 20 (FIG. 2) of the linear carrier 10. As the example embodiment shown illustrates, the carrier attachment legs 16, 18 can be snapped over the base 20, i.e. the lower horizontal flange, of a conventional inverted T grid element. Though the clips 14 can be applied in the field, they are preferably factory attached to the linear carrier 10 for quicker and easier field installation.

As best seen in FIG. 2, the clips 14 attach a plurality of planks 22 to the linear carriers 10, and, specifically in a direction perpendicular to the linear carriers. Each plank 22 includes first and second multi-directionally grooves, 23 and 24 respectively, routed, i.e. cut, through the back surface of each plank. One improvement in and of itself over existing systems is that at least a portion of these groves are sloping, and, preferably, at least a portion of each groove is sloped inwardly in the direction toward one another. In the example embodiment shown, the grooves are formed by a first cut extending from the back surface of the plank and into the interior of the plank in an outward direction. A second cut extends inwardly, thus, forming a multi-directional groove.

As shown in FIG. 2, each multi-directional groove, in turn, forms a notch 25 in a sidewall of the groove. In the example embodiment shown, a first surface portion 26 of the notch is sloped downwardly and outwardly and a second surface portion 27 is sloped downwardly and inwardly. In the example embodiment shown, the first and second surface portions 26, 27 form a 90 degree angle. As shown in FIGS. 2-6, each clip 14 has first and second projections, 28 and 30 respectively, for attaching a plank 22 to the linear carrier 10. Each projection 28, 30 embodies the profile formed by the notch 25. More specifically, these projections 28, 30 are each bent in multiple directions. As with the notch 25 of the plank 22, a first portion 31 of a protrusion extends downwardly and outwardly while a second portion 32 extends integrally from the first portion 31 and is bent downwardly and inwardly, i.e. in a direction toward the another clip protrusion.

The clips 14 are preferably made of a resilient material, such as resilient spring steel. Unlike existing linear surface covering systems, all that is required is for the projections 28, 30 of the clip 14 to contact a respective notch 25, thereby forcing the resilient projections to spread, thereby distorting the profile of the clip. Mere hand pressure in the direction of Arrow A (FIG. 2) is all that is needed to distort the clip profile and snap the plank onto the carrier. One should here an affirmative "snap" noise to indicate that the plank is in proper position on the linear carrier. Thus, the need for tool adjustment to ensure the projections of the clip achieved a deep enough seat in the grooves is eliminated. Moreover, screws are not required to more positively secure the planks to the carriers.

As shown, once the clip projections are fully seated in their respective groove, the profile will return to its undistorted, i.e. non-tensioned, profile. The notches and the portion 33 of the back of the plank between the two grooves will be encapsulated by the relaxed clip 14 and a portion of the protrusions will be positioned under the notches 32 which will serve to support a plank suspended from the linear carrier. the preferred configuration of the clip supporting a plank in a non-tensioned state, adds strength to the attachment of the plank to the carrier. In other words, as one of skill in the art would understand, a plank would be more easily removed from the carrier if the clips supporting the planks were in tension.

Figures 7, 8:
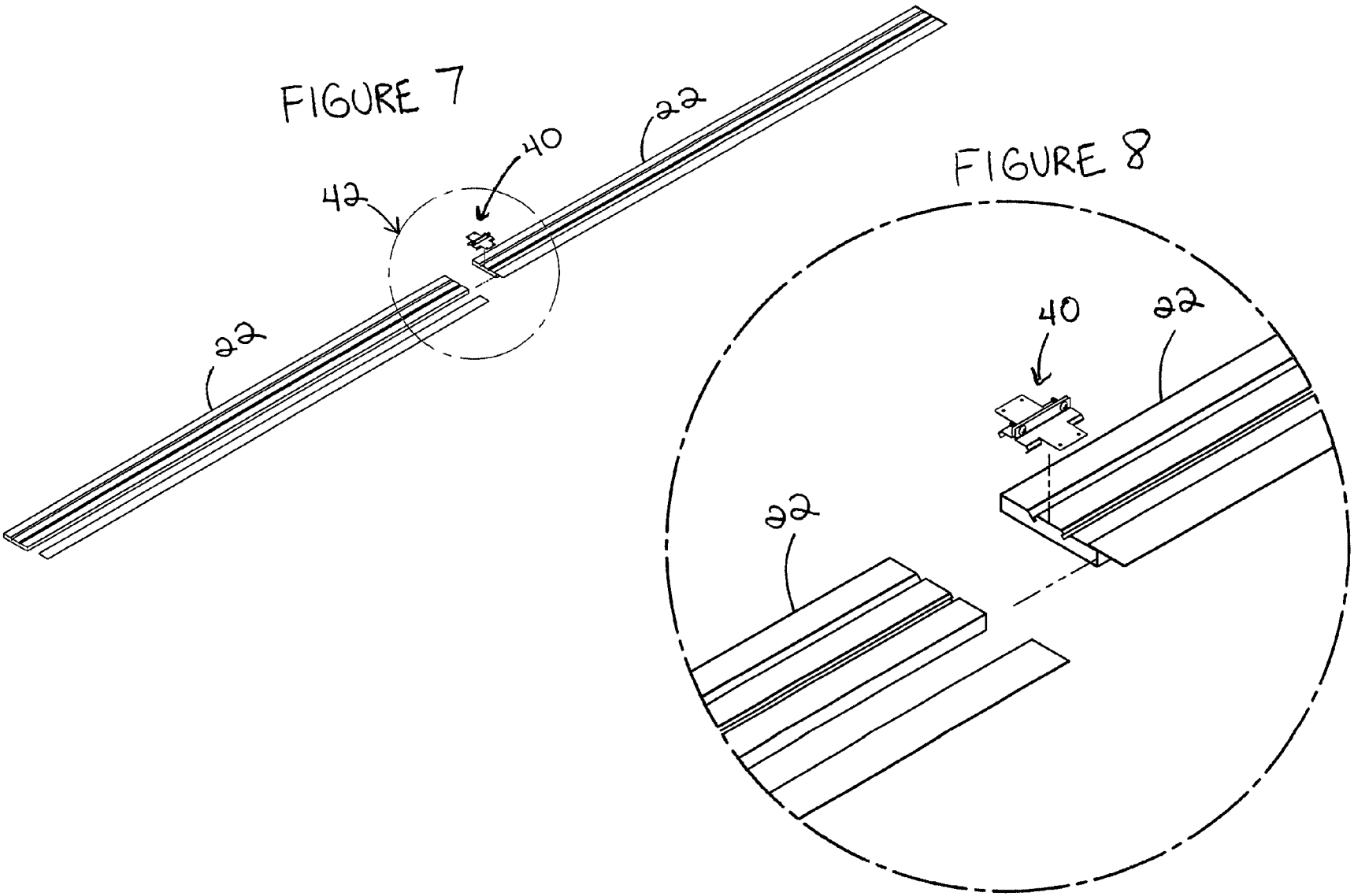
FIG. 7 is an exploded perspective view of two exemplary planks positioned end to end.
FIG. 8 is a detailed view of portion A shown in FIG. 7.
Figure 9:
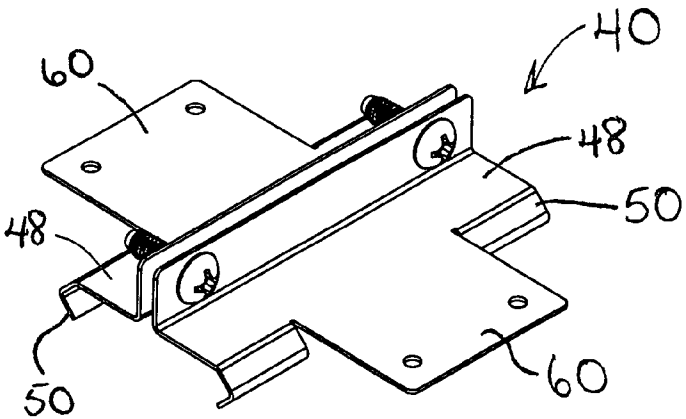
FIG. 9 is a perspective view of an exemplary splice plate.
Figure 12:
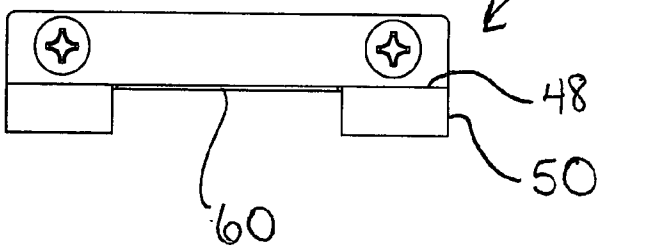
FIG. 12 is a side elevation view of an exemplary splice plate.
Figure 10:
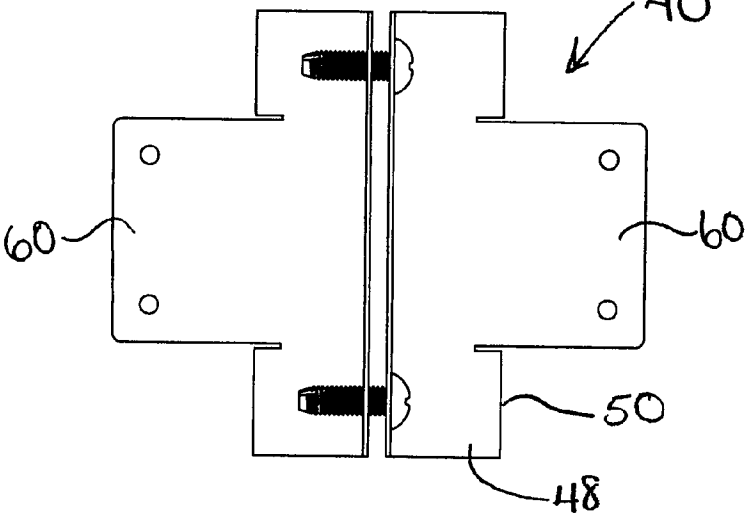
FIG. 10 is a top plan view of an exemplary splice plate.

FIGS. 7 and 8 illustrate the use of a splice plate 40 for spanning a butt joint 42 of two planks 22 positioned end-to-end. As shown in FIGS. 9-12, the splice plate is formed of two halves 44, 46, each half containing a body portion 48 and an attachment projection 50. As with protrusions 28, 30 of clip 14, each splice plate plank attachment projection 50 embodies the profile formed by notch 25. Thus, the splice plate projections 50 are bent in multiple directions as described above in reference to protrusions 28 and 30.

Figure 11:
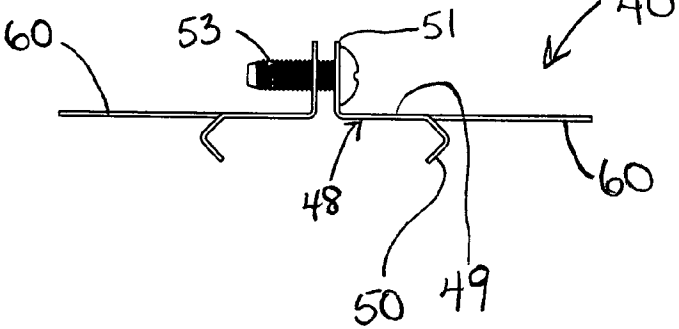
FIG. 11 is a front elevation view of an exemplary splice plate.

Further, as best shown in FIG. 11, the body portion 48 of each half includes a first portion 49 extending in a first direction and a second portion 51 extending integrally from the first portion in a direction generally perpendicular thereto. The second portions 51 of each body half include the means for attaching the body portions of each half to one another. For example, the second portions 51 of each body half may include threaded apertures for inserting one or more screw-type fasteners 53. Once the attachment projections of each half are at least partially seated in the plank grooves, the screw-type fastener can thus be used to bring the halves closer together.

The splice plate of the invention provides the capability of applying more holding force around the grooves, than, for example by, snapping the splice on the abutting planks as described below. Such capability is desirable since it holds the ends of the planks tighter at the seam which, in turn, improves the visual at the seam. In addition, the added strength of the hold helps impede twisting of the plank to prevent unevenness of the planks at the butt joint, again, improving the visual. In effect, the splice plate creates a longer length of wood, i.e. create a plank unit, and most importantly, control the location of the impact of the stresses. More specifically, several planks can act and move as one, in turn, distributing the forces acting thereon to the edges of the plank unit. An additional advantage of the splice plate is that more complex edge detail of the planks (e.g. tongue and groove configuration) is not needed to impart the necessary strength at the plank seems. Thus, the edge detail can be simplified to a flat/flush edge detail.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

For example, the grooves 23, 24 can form the notch 25 on the opposite wall, i.e. outboard wall, of a groove by inverting the direction of the cuts forming the grooves. In other words, the first surface portion 26 of the notch 25 would be sloped downwardly and inwardly and the second surface portion 27 would be sloped downwardly and outwardly. In turn, the projections 28 and 30 of the clip 14 would be bent to correspond to the contours of the notch 25. Instead of springing the protrusions outwardly, the notches would press the protrusions inwardly. As the protrusions move deeper in their respective groove, the protrusions would spring outwardly, thus seating a portion of the protrusion below the notch.

Optionally, as best seen in FIGS. 9-12, each half of the splice plate 40 may include a reinforcement wing 50 which extends outwardly from an edge of the first portion 49 of the body distal the edge from which the second portion 51 of the body 48 extends. The wings 50 span over top of the butt joint to further counteract the stresses of the plank material.

Also, the splice plate could be formed of a single piece of resilient material similar to the clips described above. Thus, in the one-piece configuration, the splice plate would be snapped over the pair of notches in a similar fashion thereto.

We claim:

1. A linear surface covering system comprising:

a plurality of linear carriers;

a plurality of planks attached to the plurality of linear carriers, each of the planks having a back surface and first and second grooves extending therethrough and into an interior of the plank, a back portion of the plank located between the first and second grooves, the back portion defining a sidewall of each of the first and second grooves and comprising a centerline;

a notch formed in the sidewall of each of the first and second grooves, wherein each notch includes: a first surface portion extending from the back surface of the plank, the first surface portion being sloped downwardly and outwardly in a direction away from the centerline of the back portion; and a second surface portion extending from the first surface portion, the second surface portion being sloped downwardly and inwardly in a direction toward the centerline of the back portion;

for each plank, a plurality of resilient clips that attach the plank to the linear carriers, each resilient clip comprising a first protrusion that extends into the first groove and engages the notch of the first groove and a second protrusion that extends into the second groove and engages the notch of the second groove such that the back portion of the plank is located between the first and second protrusions of the resilient clip;

wherein for each resilient clip, the first protrusion is configured to snap-fit into the first groove to engage the notch of the first groove and the second protrusion is configured to snap-fit into the second groove to engage the notch of the second groove; and wherein for each of the planks, the centerline of the back portion is also a centerline of the plank.

2. The linear surface covering system of claim 1 wherein each resilient clip further comprises a main body portion, the first and second protrusion located on opposite sides of the main body portion, the main body portion being adjacent the back portion of the plank.

3. The linear surface covering system of claim 1 wherein the planks extend perpendicular to the linear carriers.

4. The linear surface covering system of claim 1 further comprising a plurality of splice plates for stabilizing adjacent planks positioned in end-to-end relation, each of the splice plates comprising first and second protrusions that extend into the first and second grooves of each of the adjacent planks.

5. A linear surface covering system comprising:

a plurality of linear carriers;

a plurality of planks attached to the plurality of linear carriers, each of the planks having a back surface and first and second grooves extending therethrough and into an interior of the plank, a back portion of the plank located between the first and second grooves, the back portion defining a sidewall of each of the first and second grooves and comprising a centerline;

a notch formed in the sidewall of each of the first and second grooves, wherein each notch includes: a first surface portion extending from the back surface of the plank, the first surface portion being sloped downwardly and outwardly in a direction away from the centerline of the back portion; and a second surface portion extending from the first surface portion, the second surface portion being sloped downwardly and inwardly in a direction toward the centerline of the back portion;

for each plank, a plurality of resilient clips that attach the plank to the linear carriers, each resilient clip comprising a first protrusion that extends into the first groove and engages the notch of the first groove and a second protrusion that extends into the second groove and engages the notch of the second groove such that the back portion of the plank is located between the first and second protrusions of the resilient clip;

wherein for each resilient clip, the first protrusion is configured to snap-fit into the first groove to engage the notch of the first groove and the second protrusion is configured to snap-fit into the second groove to engage the notch of the second groove; and wherein the inner sidewall of each of the first and second grooves further comprises a third surface portion extending from the second surface portion, the third surface portion sloped downwardly and outwardly in a direction away from the centerline of the back portion.

6. A linear surface covering system comprising:

a plurality of linear carriers;

a plurality of planks attached to the plurality of linear carriers, each of the planks having a back surface and first and second grooves extending therethrough and into an interior of the plank, a back portion of the plank located between the first and second grooves, the back portion defining a sidewall of each of the first and second grooves and comprising a centerline;

a notch formed in the sidewall of each of the first and second grooves, wherein each notch includes: a first surface portion extending from the back surface of the plank, the first surface portion being sloped downwardly and outwardly in a direction away from the centerline of the back portion; and a second surface portion extending from the first surface portion, the second surface portion being sloped downwardly and inwardly in a direction toward the centerline of the back portion;

for each plank, a plurality of resilient clips that attach the plank to the linear carriers, each resilient clip comprising a first protrusion that extends into the first groove and engages the notch of the first groove and a second protrusion that extends into the second groove and engages the notch of the second groove such that the back portion of the plank is located between the first and second protrusions of the resilient clip;

wherein for each resilient clip, the first protrusion is configured to snap-fit into the first groove to engage the notch of the first groove and the second protrusion is configured to snap-fit into the second groove to engage the notch of the second groove; and wherein each of the clips further comprises a main body portion, the first and second protrusions located on opposite sides of the main body portion, and wherein each of the first and second protrusions comprise: a first portion extending from the main body portion and sloping downwardly and outwardly from the main body portion; a second portion extending from the first portion and sloping downwardly and inwardly toward the main body portion; and a third portion extending from the second portion and sloping downwardly and outwardly from the main body portion.

7. A linear surface covering system comprising:

a plurality of linear carriers;

a plurality of planks attached to the plurality of linear carriers, each of the planks having a back surface and first and second grooves extending therethrough and into an interior of the plank, a back portion of the plank located between the first and second grooves, the back portion defining an inner sidewall of each of the first and second grooves and comprising a centerline;

the inner sidewall of each of the first and second grooves comprising: a first surface portion extending from the back surface of the plank, the first surface portion being sloped downwardly and outwardly in a direction away from the centerline of the back portion; and a second surface portion extending from the first surface portion, the second surface portion being sloped downwardly and inwardly in a direction toward the centerline of the back portion;

for each plank, a plurality of resilient clips that attach the plank to the linear carriers, each resilient clip comprising a first protrusion that extends into the first groove and engages the inner sidewall of the first groove and a second protrusion that extends into the second groove and engages the inner sidewall of the second groove such that the back portion of the plank is located between the first and second protrusions of the resilient clip; and each of the first and second grooves further comprising an outer sidewall opposing the inner sidewall, the outer sidewall extending from a depth below the back surface of the plank to the back surface of the plank;

wherein the inner sidewall of each of the first and second grooves further comprises a third surface portion extending from the second surface portion, the third surface portion sloped downwardly and outwardly in a direction away from the centerline of the back portion; and wherein each of the resilient clips further comprises a main body portion, the first and second protrusions located on opposite sides of the main body portion, and wherein each of the first and second projections comprise: a first portion extending from the main body portion and sloping downwardly and outwardly from the main body portion; a second portion extending from the first portion and sloping downwardly and inwardly toward the main body portion; and a third portion extending from the second portion and sloping downwardly and outwardly from the main body portion.

8. The linear surface covering system of claim 7 wherein the outer sidewall of each of the first and second grooves extends from the third surface portion to the back surface of the plank, the outer sidewall being sloped upwardly and outwardly in a direction away from the centerline of the back portion.

9. A linear surface covering system comprising:

a plurality of linear carriers;

a plurality of planks attached to the plurality of linear carriers, each of the planks having a back surface and first and second grooves extending therethrough and into an interior of the plank, a back portion of the plank located between the first and second grooves, the back portion defining an inner sidewall of each of the first and second grooves and comprising a centerline;

the inner sidewall of each of the first and second grooves comprising: a first surface portion extending from the back surface of the plank, the first surface portion being sloped downwardly and outwardly in a direction away from the centerline of the back portion; and a second surface portion extending from the first surface portion, the second surface portion being sloped downwardly and inwardly in a direction toward the centerline of the back portion;

wherein for each of the inner sidewalls of each of the first and second grooves, the first surface portion and the second surface portion converge at an apex;

for each plank, a plurality of clips that attach the plank to the linear carriers, each clip comprising a first protrusion that extends into the first groove and engages the inner sidewall of the first groove and a second protrusion that extends into the second groove and engages the inner sidewall of the second groove such that the back portion of the plank is located between the first and second protrusions of the clip;

wherein the inner sidewall of each of the first and second grooves further comprises a third surface portion extending from the second surface portion, the third surface portion sloped downwardly and outwardly in a direction away from the centerline of the back portion; and wherein each of the clips further comprises a main body portion, the first and second protrusions located on opposite sides of the main body portion, and wherein each of the first and second projections comprise: a first portion extending from the main body portion and sloping downwardly and outwardly from the main body portion; a second portion extending from the first portion and sloping downwardly and inwardly toward the main body portion; and a third portion extending from the second portion and sloping downwardly and outwardly from the main body portion.

* * * * *